United States Patent [19]

Elliott, Jr.

[11] Patent Number: 4,640,176

[45] Date of Patent: Feb. 3, 1987

[54] QUICK DISCONNECT RETAINER FOR A DETACHABLE DRUMSTICK HEAD

[76] Inventor: Francis J. J. Elliott, Jr., Band, OPS Co., H&S BN, MCDEC, Quantico, Va. 22134

[21] Appl. No.: 662,345

[22] Filed: Oct. 18, 1984

[51] Int. Cl.[4] ..... G10D 13/02

[52] U.S. Cl. ..... 84/422 S

[58] Field of Search ..... 84/421, 422, 458; 403/19-20, 258, 260-261, 289-290; 411/508-510, 517, 521

[56] References Cited

U.S. PATENT DOCUMENTS

| | | | |
|---|---|---|---|
| 2,626,772 | 1/1953 | Flora | 411/510 X |
| 2,901,787 | 9/1959 | Whistler et al. | 403/19 |
| 3,151,518 | 10/1964 | Zarcone et al. | 84/422 S |
| 3,606,406 | 9/1971 | Walters | 403/261 X |
| 4,276,805 | 7/1981 | Kaneko | 84/458 |

FOREIGN PATENT DOCUMENTS

| | | | |
|---|---|---|---|
| 9852 | of 1906 | United Kingdom | 84/422 S |

*Primary Examiner*—Laurence R. Franklin

*Attorney, Agent, or Firm*—Shoemaker and Mattare, Ltd.

[57] ABSTRACT

A quick connect/disconnect retainer structure for detachable drumstick heads is provided. A conventional-type drumstick may be used, or a modified one used if preferred. The modified one is provided with a circumferentially extending flange a short distance from the tip end of the drumstick. In either situation, the tip end of the drumstick is provided with a central aperture and female threads therewith.

The retainer structure per se comprises a cylindrical body having a central projection from one end thereof which is suitably threaded for engagement with the female threads of the drumstick. The other side of the body member is provided with a plurality of spring fingers. Each spring finger has an outwardly tapered surface for engagement by a suitable tool with camming action thereby for the purpose of pressing the fingers radially inwardly when desired. Close to the base of each spring finger a circumferential recess is provided. A retainer washer having a central opening just slightly smaller than the outer circumference of the plurality of spring fingers is mounted within the recesses of the spring fingers to retain a replaceable head in position on the drumstick.

A tool having a conical recess at one end and preferably magnetized at the same end can be used to move the spring fingers radially inwardly to release the retainer washer, and the magnetism of the end will suitably retain the retainer washer with the tool upon removal and prevent loss thereof.

17 Claims, 6 Drawing Figures

QUICK DISCONNECT RETAINER FOR A DETACHABLE DRUMSTICK HEAD

BACKGROUND OF THE INVENTION

1. Field of the Invention

This invention relates generally to structure for attaching and retaining a detachable drumstick head on a drumstick, and yet permitting easy change and replacement thereof when desired.

2. Description of the Prior Art

A common problem with known devices for attaching/detaching drumstick heads to a drumstick is that they often are fairly time consuming to attach and detach, require the use of specialized tools, or fail to securely retain the drumstick head on the drumstick until such time as it is desired to remove same.

Another common problem of known clamping and attachment structure for drumstick heads is that they either secure the head too firmly, and thus are very difficult to use when it is desired to detach the head, or else they do not firmly retain the head, and thus permit the head to be loose on the drumstick.

Another common problem with known drumstick head attaching devices is that they do not provide the speed of changing which is oftentimes desirable in actual practice and use of the device.

SUMMARY OF THE INVENTION

An object of the present invention is to provide a quick disconnect retainer for a detachable drumstick head to permit the rapid release of same when it is desired to change and/or replace it.

Another object of this invention is to provide a quick connect/disconnect structure for a body-type element from a rod or stick-like element.

A further object of this invention is to provide a replaceable connect/disconnect structure having a plurality of extending fingers which can be deformed inwardly as appropriate to permit the release of a retaining disc or washer when desired. A tool for performing the quick connect/disconnect function is also provided. The tip of the tool may also be magnetized for retention of the retainer disc upon removal thereof.

Yet another object of the present invention is to provide an easily replaceable, quick connect/disconnect structure for the tip end of a drumstick, which structure has a plurality of fingers, three or more in number, which can be deformed inwardly to release a retaining disc therefrom. A tool to mate with and move the fingers inwardly is also provided as part of this invention.

The present invention has a number of new and important features over known prior art. It is a small structure which can be added to the end or tip of a conventional-type drumstick, or one especially modified for use with this device, and comprises a cylindrical body element having a central projection extending from one end thereof which is appropriately provided with screw threads. The other end of the body element has a plurality of spring fingers extending therefrom. At least three fingers are preferably used, while four, five, six, or more can be used. By using an even number of fingers such as four or six, the structure is very easily machined from bar stock in conventional-type metal working apparatus.

Each spring finger has a tapered tip end and is also provided with a circumferential recess where the finger joins the main cylindrical body or near thereto. A retainer disc or washer having an aperture therethrough, with the diameter of the aperture just slightly less than the diameter across opposite finger recesses, can be pushed onto the spring fingers, and because of the sloping tapered outer surface of each finger, pushed into engagement with the circumferential recesses of the respective fingers. Once the washer is in place, a drumstick head, or the like, will be securely fastened onto the end of the longitudinal rod or drumstick.

Preferably, a tool having a conical recess at one end is provided for ease and quickness of removal of the retainer washer. The tip end of the tool also may be magnetized so that if a metal retainer washer is used, the retainer washer will be held by the tool upon removal therefrom, and thus the possibility of dropping and losing same, etc. will be avoided.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT(S)

Figure 1:
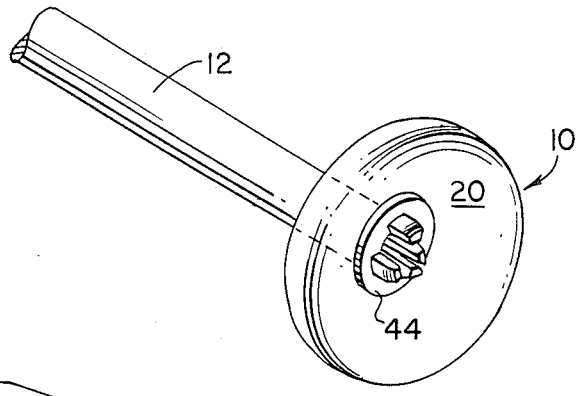
FIG. 1 is a perspective view of the present invention with the quick connect/disconnect structure in place and retaining a drumstick head on the tip of a drumstick.

Looking at FIG. 1 of the drawings, reference numeral 10 indicates in general the quick connect/disconnect structure of the present invention. A drumstick 12 has a replaceable drumstick head 20 mounted thereupon by the quick connect/disconnect structure as disclosed herein.

Figure 2:
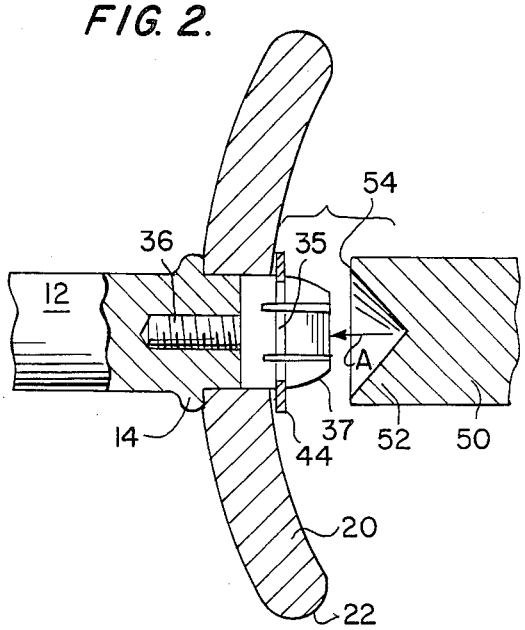
FIG. 2 is a side elevational view, partly in cross section, showing the drumstick head combination of FIG. 1 together with the tip end of a release tool.
Figure 3:
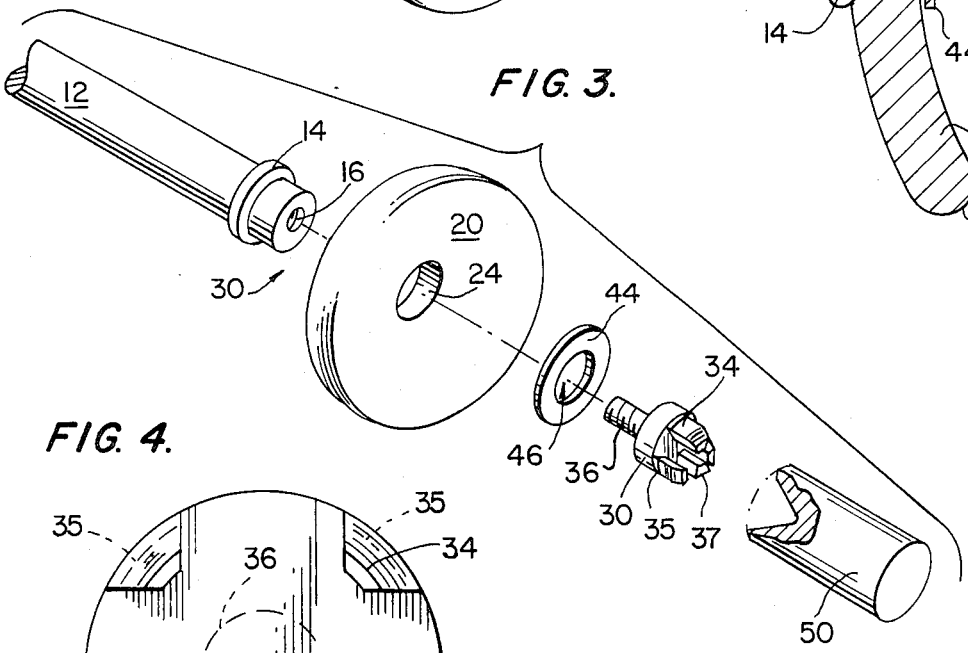
FIG. 3 is an exploded perspective of the components of FIGS. 1 and 2 with a tool insert which is usable for quickly removing the retaining washer portion of the structure.

As best seen in the side elevation of FIG. 2 and the exploded perspective of FIG. 3, the quick connect/disconnect structure comprises a cylindrical body 30 having a centrally extending projection 36 suitably provided with male threads thereon. This tapped projection is of appropriate size to screw into the female tapped aperture 16 at the end of drumstick 12. A conventional-type drumstick may be modified for use with this device, or a specially configured one having a raised circumferential flange 14 spaced a short distance away from the tip end may be used. The outer diameter of body 30 is of the same approximate size as the diameter of aperture 24 through the middle of the drumstick head 20. The outer circumference of the head 20 is provided with a curved edge 22 (as seen in cross-section) for engagement with the drumhead. As can be clearly seen in the side view of FIG. 2, the head 20 has a concave outward shape. This is one of the species as disclosed and claimed in a co-pending application filed by the applicant. Of course, the other species of beater heads as depicted in the co-pending application can all be used with the quick connect/disconnect structure of the present invention.

Figure 4:
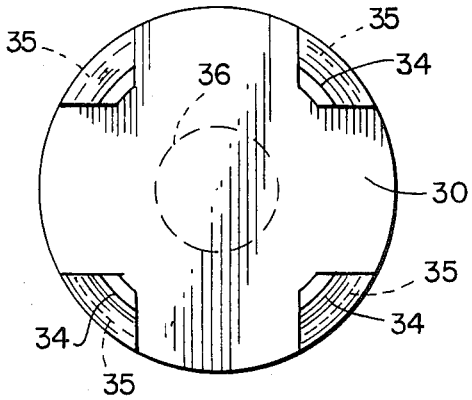
FIG. 4 is an end elevational view of the embodiment shown in FIGS. 1–3.

The cylindrical body 30 has a plurality of spring fingers projecting from the opposite end thereof to the tapped projection 36. In the preferred embodiment, a plurality of four spring fingers, as shown in end elevation in FIG. 4, are provided. A circumferential recess 35 is also provided at the junction point of each spring finger with the body, or closely adjacent thereto. As seen in FIG. 2, the recess portion 35 is spaced a small distance from the edge of the cylindrical body 30.

A retainer washer 44 having an aperture 46 therethrough is mounted within the recess 35 of the respective fingers to secure and retain the drumhead 20 on the drumstick 12.

As best seen in FIGS. 2 and 3, a specially made tool insert 50 having a conical recess 52 at one end thereof can be used to deform the spring fingers 35 when it is time to remove and change the beater head.

As is quite clear from the view of FIG. 2, when the tool insert 50 is pushed in the direction of arrow A, the conical tapered recess 52 will engage the respective tapered tip surfaces 37 of the spring fingers to move them inwardly and thus depress the retainer portion of recesses 35 from retention with the retainer washer 44. If the washer is made of the recommended magnetic metallic material, the end surface 52 of the tool insert 50 can be suitably magnetized so as to hold the retainer washer when the washer is removed. Of course, tool insert 50 can be used at the end of a screwdriver or nut-driver type handle, or adapted for use with socket wrench handles and the like. The important features are the conical recess 52 and the magnetized end surface 54 which the tool should have regardless of whatever holding/actuating type handle is used.

While, as shown in FIG. 4, the preferred embodiment of the present invention uses four spring fingers 34, which makes it easy to machine the entire retainer body 30 with fingers on conventional type metal working apparatus, it also is envisioned that other numbers of spring fingers can be utilized.

Figure 5:
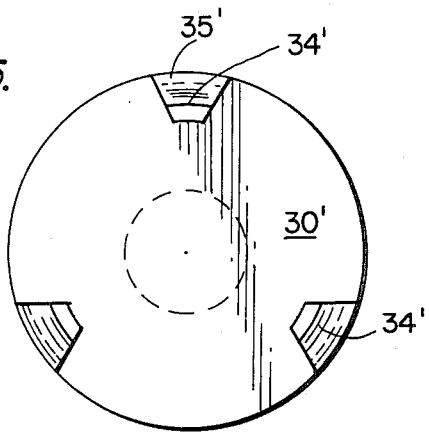
FIG. 5 is a modified embodiment depicting three spring fingers instead of four.

For example, in FIG. 5 three spring fingers 34' extending from the cylindrical body 30' are shown. In actual practice it has been discovered that at least three fingers should be used, since less than that number will not provide enough support and securement for the retainer washer 44.

Figure 6:
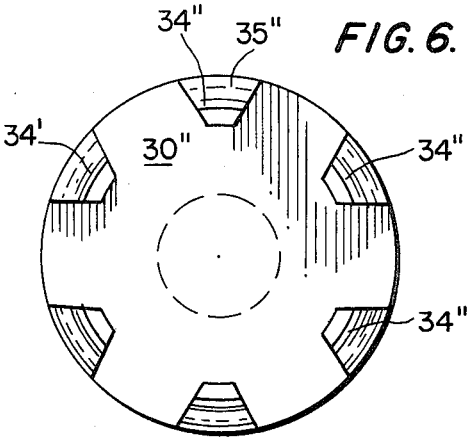
FIG. 6 is a further modified embodiment showing the use of six spring fingers.

However, more than three or four spring fingers can also be used, if desired. For example, in FIG. 6 a total of six spring fingers 34" are shown on the body 30". Again, having an even multiple number of fingers permits easy cutting of the fingers from the bar stock from which the body 30, 30' or 30" is made. Though not shown in the drawings, spring fingers numbering five, seven, eight, etc. can also be used.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A connector for a drumstick having a removable head comprising:

a main body element;

attachment means at one end of said main body element to permit semi-permanent attachment thereof to an elongated drumstick;

connector means at the other end of said main body element for quickly attaching and detaching a drumstick head thereto;

retainer means operable in conjunction with said connector means for securing said head in place upon a drumstick;

said attachment means at one end of said main body element comprising a central projection extending therefrom for complementary engagement with an aperture in the end of said drumstick;

said centrally extending projection being externally threaded;

said drumstick having internal threads provided within said aperture for complementary engagement with the external threads of said projection;

said connector means at the other end of said main body element comprising spring means which are movable radially for engagement with said retainer means in releasable fashion; and said spring means comprising a plurality of resilient fingers extending from the other end of said main body element.

2. The connector for a drumstick of claim 1, wherein said spring fingers are at least three in number.

3. The connector for a drumstick of claim 1, wherein said spring fingers are at least four in number.

4. The connector for a drumstick of claim 1, wherein said spring fingers are at least six in number.

5. The connector for a drumstick of claim 1, wherein said retainer means operable in conjunction with said connector means comprises a retainer washer having a central aperture therethrough, said aperture having a diameter slightly smaller than the outer circumference of said plurality of spring fingers.

6. The connector for a drumstick of claim 5, wherein each of said spring fingers is provided with a circumferential recess for reception of said retainer washer therewithin.

7. The connector from a drumstick of claim 6, together with a tool for quickly and easily removing said washer from said spring fingers.

8. The connector for a drumstick of claim 7, wherein said tool further includes a conical recess for camming engagement with said spring fingers for the purpose of moving them radially inwardly for releasing the retainer washer therefrom, and said tool further having a magnetic tip for holding magnetic retainer washers upon removal from said connector.

9. A connector for a drumstick having a removable head comprising:

a main body element;

attachment means at one end of said main body element to permit semi-pemnanent attachment thereof to an elongated drumstick;

connector means at the other end of said main body element for quickly attaching and detaching a drumstick head thereto;

retainer means operable in conjunction with said connector means for securing said head in place upon a drumstick;

said connector means at the other end of said main body element comprising spring means which are movable radially for engagement with said retainer means in releasable fashion; and said spring means comprising a plurality of resilient fingers extending from the other end of said main body element.

10. The connector for a drumstick of claim 9, wherein said retainer means operable in conjunction with said connector means comprises a retainer washer having a central aperture therethrough, said aperture having a diameter slightly smaller than the outer circumference of said plurality of spring fingers.

11. The connector for a drumstick of claim 10, wherein each of said spring fingers is provided with a circumferential recess for reception of said retainer washer therewithin.

12. The connector for a drumstick of claim 11, together with a tool for quickly and easily removing said washer from said spring fingers.

13. The connector for a drumstick of claim 12, wherein said tool further includes a conical recess for camming engagement with said spring fingers for the purpose of moving them radially inwardly for releasing the retainer washer therefrom.

14. The connector for a drumstick of claim 13, wherein said tool further includes a magnetic tip for holding magnetic retainer washers upon removal from said connector.

15. The connector for a drumstick of claim 11, wherein said spring fingers are at least three in number.

16. The connector for a drumstick of claim 11, wherein said spring fingers are at least four in number.

17. The connector for a drumstick of claim 11, wherein said spring fingers are at least six in number.

* * * * *

UNITED STATES PATENT AND TRADEMARK OFFICE

CERTIFICATE OF CORRECTION

PATENT NO. : 4,640,176

DATED : Feb. 3, 1987

INVENTOR(S) : Francis J. J. Elliott, Jr.

It is certified that error appears in the above-identified patent and that said Letters Patent is hereby corrected as shown below:

Address of the inventor should read as follows:

PerPro Incorporated
210 Westport Road
Kansas City, Mo. 64111

Signed and Sealed this

Twenty-first Day of April, 1987

*Attest:*

DONALD J. QUIGG

*Attesting Officer*

*Commissioner of Patents and Trademarks*